United States Patent [19]

Larkins

[11] 4,103,651

[45] Aug. 1, 1978

[54] INTERNAL COMBUSTION-GAS TURBINE ENGINE

[76] Inventor: John S. Larkins, Moun't Valley Farm, #5, Box 60, New Castle, Va. 24127

[21] Appl. No.: 712,658

[22] Filed: Aug. 9, 1976

[51] Int. Cl.[2] ..... F02B 59/00

[52] U.S. Cl. ..... 123/50 B; 91/400; 92/108; 92/117 R

[58] Field of Search ..... 123/50 R, 50 A, 50 B, 123/52 B, 58 C; 91/400; 92/107, 108, 117 R

[56] References Cited

U.S. PATENT DOCUMENTS

| | | | |
|---|---|---|---|
| 1,044,096 | 11/1912 | Sorg | 123/50 A |
| 1,177,126 | 3/1916 | Miller | 123/58 C |
| 1,211,339 | 1/1917 | Outerbridge | 123/50 A |
| 1,844,478 | 2/1932 | Omo | 123/50 A |
| 2,040,453 | 5/1936 | Weber | 123/50 R |
| 2,458,672 | 1/1949 | Zoch | 123/50 R |
| 2,786,458 | 3/1957 | Luttrell | 123/50 R |

FOREIGN PATENT DOCUMENTS

| | | | |
|---|---|---|---|
| 1,425 of | 1915 | United Kingdom | 123/58 A |

*Primary Examiner*—Robert E. Garrett
*Attorney, Agent, or Firm*—Harry R. Dumont

[57] ABSTRACT

An engine of the air-cooled, super-charged type which includes a stationary piston, a cylinder movable relative to the piston and operable in a first position to provide a compression chamber between adjoining ends of the cylinder and piston. In a second position, the compression chamber is opened to provide purging air flow from a compressor stage. A cooling air flow is provided about the surfaces of the cylinder and piston in both positions of the cylinder and during its travel between those positions.

In a different embodiment of the engine, the internal combustion portion of the engine just described above is combined with a gas turbine stage. Upon firing of the fuel in the compression chamber and the subsequent opening of the chamber, the flow of hot gases is applied to provide a further rotative force to the turbine wheel.

In a still further embodiment of the invention, no timed ignition of the fuel is required but, during the compression stroke of the cylinder, the fuel is ignited in a diesel engine mode of operation.

An additional embodiment of the invention also includes a standard gas turbine engine stage adapted to receive a separate pressurized flow from the compressor to add to the smoothness and to the power output of the combined engine.

23 Claims, 12 Drawing Figures

INTERNAL COMBUSTION-GAS TURBINE ENGINE

REFERENCE TO RELATED APPLICATION

This application is related to my copending application Ser. No. 631,040, filed Nov. 12, 1975, now U.S. Pat. No. 4,048,798, issued Sept. 20, 1977, for ATMOSPHERIC PRESSURE DIFFERENTIAL ENGINE.

BACKGROUND OF THE INVENTION

This invention is related to a new type of engine in which combustion is provided in a compression chamber between a fixed piston and a movable cylinder, both of the annular shaped type. It is well known in the prior art that it is possible by combustion of a fuel, liquid or gas, to provide a controlled expansion of gases in such manner as to provide movement of a piston in a cylinder and then provide a mechanical power take-off from the piston movement. A variety of engines are known in which gas and air are mixed and then ignited to provide the piston movement. In others, pre-mixed gas and air are compressed before ignition. These engines generally known by the term internal combustion engines require carefully controlled ignition of the fuel and rather complex lubrication and cooling systems in view of the high temperatures and the rapid reciprocating movements of the parts. In standard internal combustion engines, it is further necessary to provide a large number of exceedingly close tolerance parts so that the cost is high and in many cases the final product is not suitable because of its cost and weight for powering motor cars or the like.

In addition, internal combustion engines are most economical when using petroleum products such as gasoline or diesel oil. These fuels will become relatively scarce in the near future and hence will be more expensive. The present invention makes it possible to use a broad variety of fluid and gas fuels.

The prior art also has provided a great variety of gas turbine engines. The underlying principle of operation for such engines is to compress the air in a compressor, to inject the fuel to raise the temperature of the air, and finally to direct the hot air flow against the blades of a turbine wheel to give a rotational mechanical movement of the wheel and thus perform work. In some cases, separate engines are used for compressing the air, or a part of the power developed by the turbine is used for driving a compressor. A problem that always arises from turbines is that the hot air being used to impinge against the turbines allows only a limited number of materials to be used in forming the turbine blades because of the high temperatures involved. This makes the turbine engine both expensive and difficult to manufacture. An even more important consideration is that gas turbine engines typically use at least two thirds of the heat power generated in driving the compressor. This results in an efficiency for gas turbine engines of 25% at best.

The present invention will be seen to relate to an engine in which air cooling is provided in such manner that the rotating or reciprocating working parts are not subjected to excessively high temperatures, high pressures nor to the effects of hot expanding gases in such manner as to require expensive and heavy construction engine parts. To the contrary, the combustion of the fuel is used for initiating a two-cycle mode of operation of a cylinder and piston. The associated working parts are continuously air cooled and the compression chamber itself is subjected to a complete scavenging flow. The complete scavenging flow effect results in a virtually pollution-free engine with a cylinder and piston design which prevents concentrated hot spots. In this way, the formation of the polluting compounds of nitrogen is largely prevented.

The pressure from the fuel being combusted in the compression chamber between the movable cylinder and stationary piston is utilized in the following turbine stage in the combined engine version of my invention. There is provided a continuous cooling effect, particularly through the unique arrangement of ports in the movable cylinder. An even more significant feature of my invention is that there is allowed a purging of the compression chamber during the movement of the cylinder away from the piston such that there is provided an almost complete removal of incompletely combusted elements of the fuel. There is provided a lowering of temperature along with the removal of noxious substances to provide clean burning of each following fuel charge.

Viewed in its broadest aspect, the present invention provides a greatly improved and novel two-cycle type internal combustion engine of either the ignition system fired or the diesel type. It further combines such an engine with a gas turbine stage or stages such that the input of compressed air to the engine provides a continuous cooled driving effect to a turbine stage which is positioned in the engine outlet. The turbine stage is further in driven communication with the hot gases provided from firing of the fuel within the internal combustion engine compression chamber.

BRIEF DESCRIPTION OF THE INVENTION

The present invention will thus be seen to provide a novel and improved supercharged, air-cooled engine capable of burning virtually any combustible fuel, gaseous or liquid. The engine further has the outstanding advantage in one embodiment of including a movable cylinder of the annular type which cooperates with a stationary piston likewise of the annular type in such manner as to provide between them a compression chamber for the firing of the fuel therein. In the intermediate and in the extreme moved positions of the cylinder, the compression chamber is opened wide to provide flow therethrough of the pressurized air input from a compressor stage so that complete scavenging and purging of the chamber results. The longitudinal reciprocating movement of the cylinder is translated into a rotative movement through a crankshaft connection. The same crankshaft connection is preferably utilized to provide the necessary drive for the compressor. The result of my invention is an improved two-cycle type internal combustion engine which may be combined with a gas turbine stage to provide a greatly improved combination of the two in a manner not heretofore known.

BRIEF DESCRIPTION OF THE DRAWINGS

Reference is made to the accompanying drawings for an explanation of the present invention and to the several views in which like parts are referred to with like numerals, and wherein.

DETAILED DESCRIPTION OF THE SEVERAL EMBODIMENTS

Figures 1, 2:
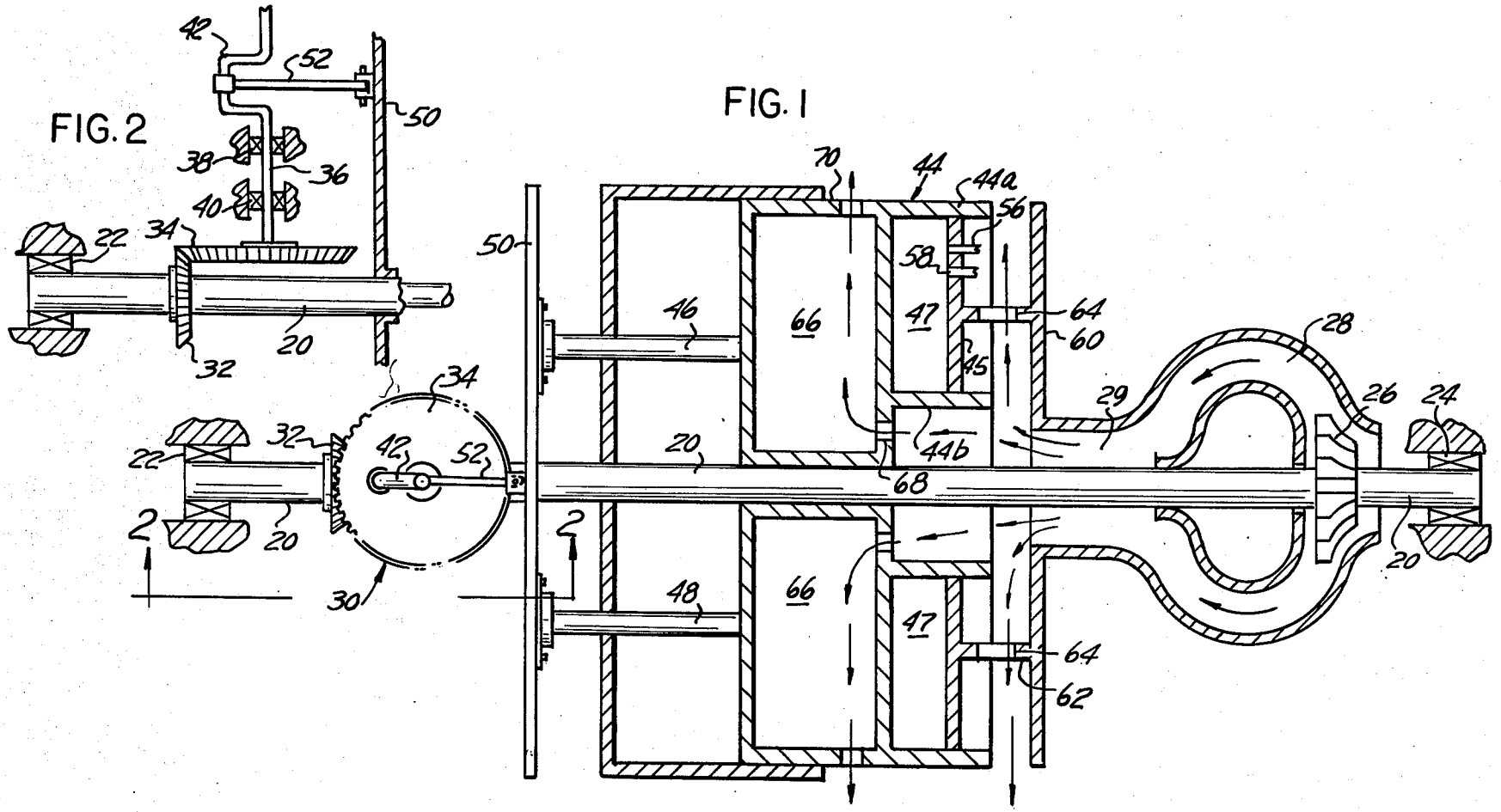
FIG. 1 is a cross-sectional view with parts broken away showing the internal combustion engine according to my invention.
FIG. 2 is a sectional view taken along the section line 2—2 of FIG. 1 further showing the detail of the compressor drive and the associated parts of the power take off mechanism.

FIG. 1 shows the internal combustion engine of my invention in which a drive shaft 20 is mounted for rotation between bearings 22 and 24 at its left and right ends, respectively. An axial compressor 26 is mounted on the shaft 20 near its right-hand end. It will be seen that the internal combustion engine which incorporates my invention is air-cooled and supercharged in operation. The several different pressurized air flow paths which will be further clarified hereinafter are shown by arrows as they are initiated by the compressor 26 and passed through an input housing 28. There is further included in the FIG. 1 drawing the mechanism for driving the compressor 26 which is indicated generally by the numeral 30. The parts of the compressor drive mechanism 30 include a pinion gear 32 pinned near the left-hand end of the shaft 20 and a larger diameter drive gear 34 having its teeth in mesh with those of the pinion gear 32. And as further clarified in FIG. 2, the drive gear 34 is fixed to a vertical shaft 36 which in turn is supported for rotation in a vertical plane by a pair of spaced bearings 38 and 40. A crankshaft 42 is formed near the upper end of the shaft 36. The rotative drive of the shaft 36 is received from the reciprocal longitudinal movement of a cylinder 44. The right-hand end of the annular shaped cylinder 44 is cooperable with a piston 45 as shown. In the right-hand compression position of the cylinder 44, a compression chamber 47 is formed between the cylinder 44 and the piston 45. A coupling of a pair of pushrods 46, 48 converts the longitudinal movement of the cylinder 44 into a rotative drive for the gear 34 through the operation of linkage including pushrods 46, 48, link 50 and a connecting rod 52, respectively.

An important feature of my invention resides in the fact that the compressor 26 drive and the operation of the engine particularly with its specialized cylinder and porting arrangement to be described hereinafter, controls the pressure and the temperature of the gases during both the exhaust portion and the next following scavenging portion of the engine cycle. In its operation, the internal combustion engine will be seen to operate as a two-cycle internal combustion engine. With appropriate design, the engine of FIG. 1 can be operated as a diesel engine without requiring a timed ignition system for each consecutive firing cycle. Alternately, the stationary piston 45 of the engine of FIG. 1 can have incorporated in it a fuel inlet 56 and a firing device or spark plug 58 so that in timed relationship in accordance with the cycle of the engine, fuel is admitted to the compression chamber 47 and then fired by an igniting means such as plug 58 at the optimum time to initiate a power stroke of the engine cylinder 44. Such ignition systems and their timed operation are well known in the engine arts.

The housing 28 encloses the drive shaft 20 and includes a channel 29 which extends outwardly in a flange 60. The piston 45 is connected to the flange by an annular ring 62. The ring 62 has a plurality of spaced ports 64 extending through it to allow the pressurized air flow paths shown by arrow. The effect of the passage of air is to continuously cool the outer surface of the piston 45.

The cylinder 44 will be seen to also be of an annular shape. It includes a pair of rightwardly extending rings 44*a*, 44*b* which extend beyond the piston 45 in the compression position thus forming the compression chamber 47. The cylinder 44 further includes a left hand chamber portion 66. A plurality of ports 68 are included in the lower wall of the chamber 66 to receive the pressurized air flow from the compressor 26. A second peripheral plurality of exit ports 70 are also formed in the chamber 66. A cooling air flow path thus is passed about the bottom and side of the cylinder 44.

Figure 3:
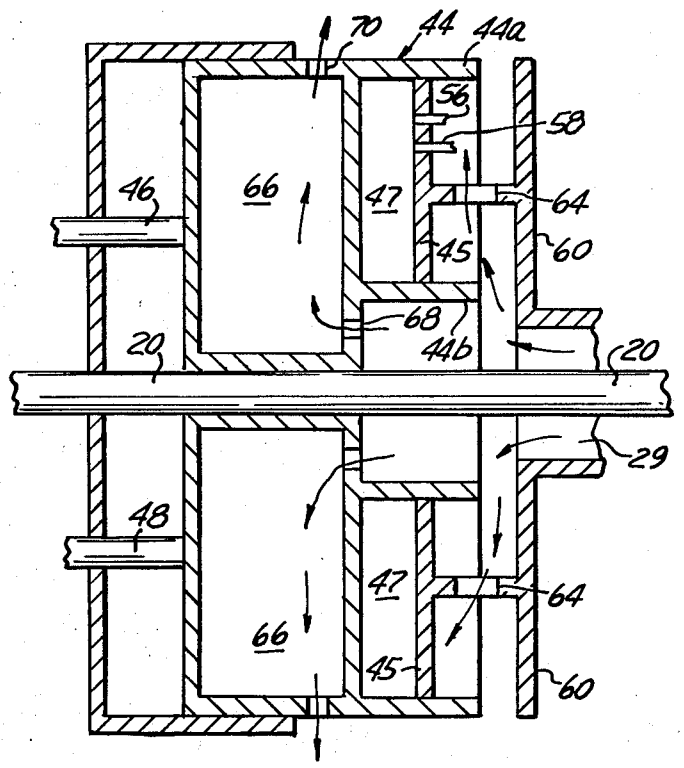
FIG. 3 is a cross-sectional view of a portion of the mechanism of FIG. 1 with parts broken away illustrating the compression position of the cylinder relative to the piston.

FIG. 3 illustrates the relationship between the cylinder 44 and the piston 45. The rings 44*a*, 44*b* extend well beyond the piston 45 to enclose the compression chamber 47.

Figure 4:
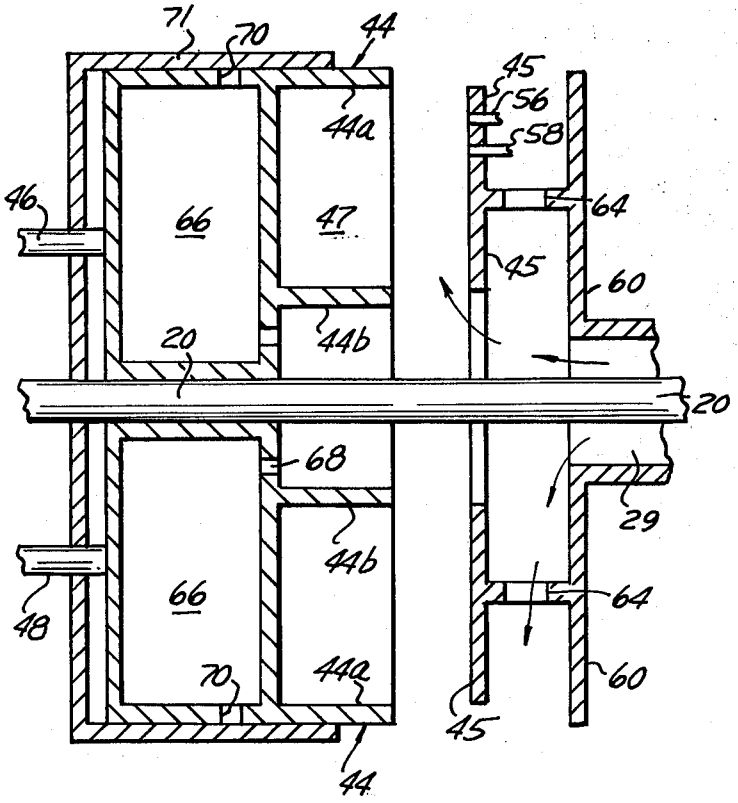
FIG. 4 is a further view similar to FIG. 3 but with the cylinder in its left hand moved position in its scavenging position.

FIG. 4 shows the cylinder 44 in its extreme left-hand scavenging position. The upper port 70 of the chamber 66 is now closed so that pressurized air flow is directed in the manner shown to purge the now opened compression chamber. The major flow path is through the inlet 29, along the shaft 20 and outward through the clearance left between rings 44*a*, 44*b* and the piston 45. A second air flow path is maintained outwardly through the ports 64 as shown. It will be understood that suitable alignment and support means are provided to allow for the movement of the parts as shown in FIG. 4.

Figure 5:
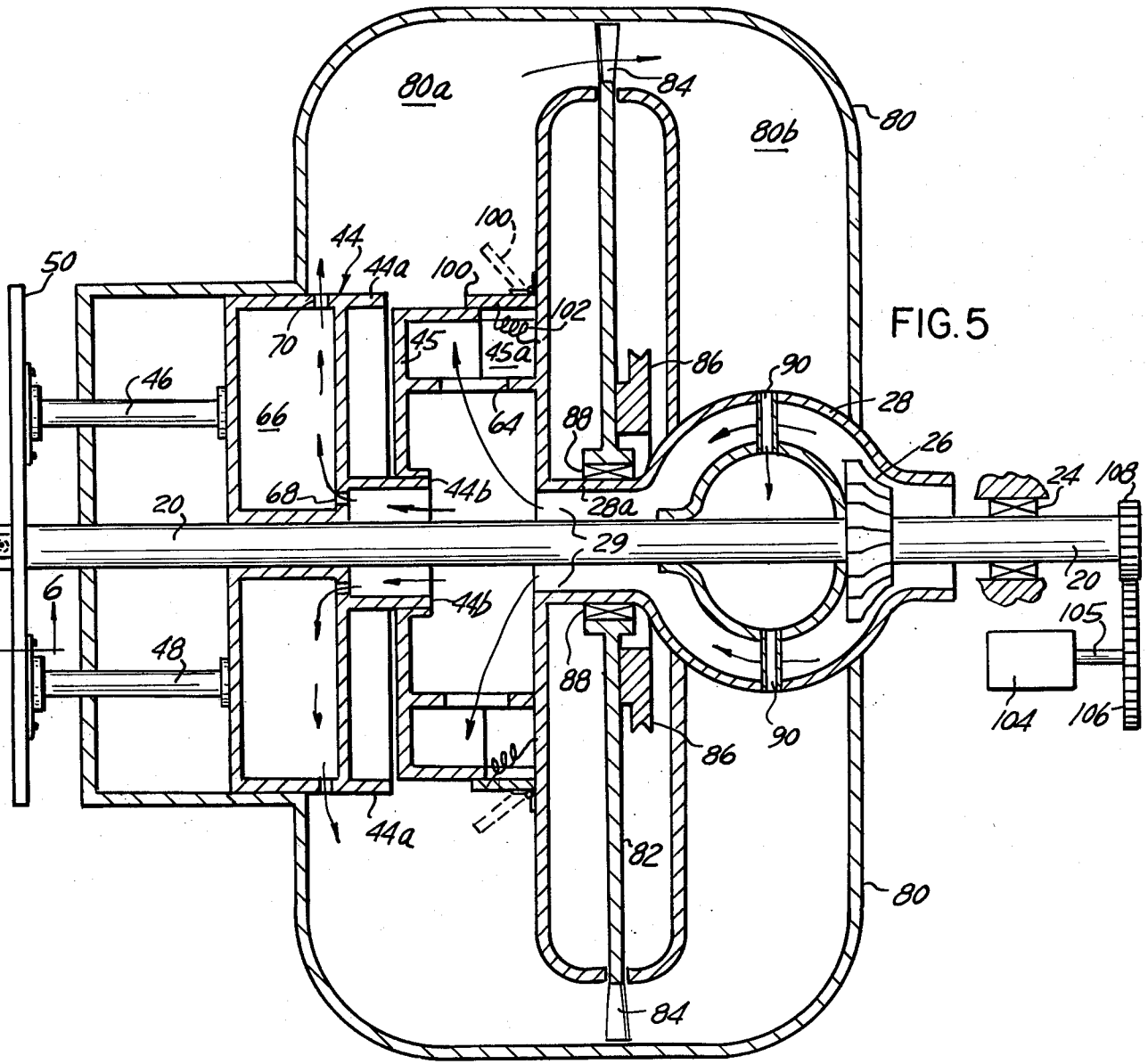
FIG. 5 is a cross-sectional view with parts broken away of a combined internal combustion and gas turbine engine showing the power take-off being derived from the gas turbine stage of the engine.
Figure 6:
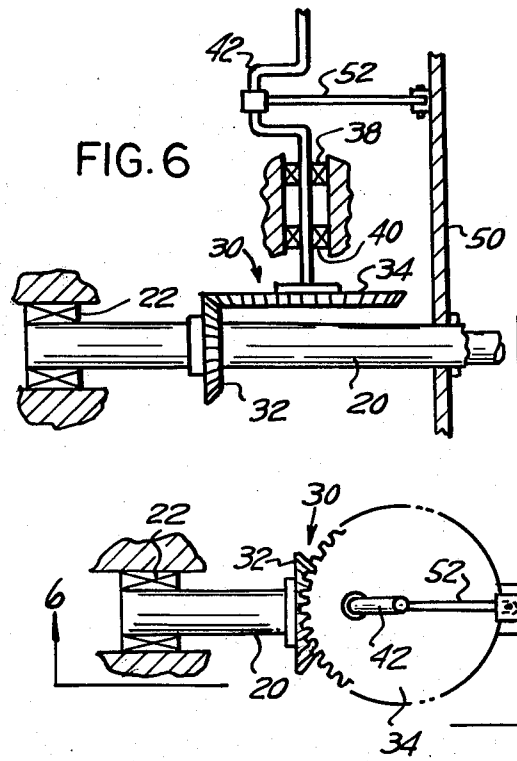
FIG. 6 is a sectional view taken along the section line 6—6 of FIG. 5 and further showing the detail of the mechanism used to drive the compressor stage of the engine.

FIGS. 5 and 6 show an alternate embodiment of my invention in which the internal combustion engine is combined with a gas turbine engine. The gas turbine portion is located at the right end of the drawing and includes a housing 80 which encloses the operating cylinder 44 and piston 45.

Included in the turbine portion of the engine is a turbine wheel 82 having a plurality of turbine blades 84 mounted about its periphery. A power take-off pulley 86 extends rightwardly from the hub of the turbine wheel 82. The turbine wheel 82 is further rotatably mounted on a bearing 88 fixed to a left-hand extension 28*a* of the inner housing 28. The housing 80 will be seen to enclose a left-hand chamber 80*a* and a right-hand chamber 80*b*. Responsive to pressurized air flow from chamber 80*a* to chamber 80*b*, the turbine wheel 82 will be rotatively driven to provide a power take-off from the pulley 86 by a belt or like means not shown. A further plurality of ports 90 are circumferentially arrayed and extend through the housing 28 to ambient thus to provide an exiting flow of mixed air and other gases from the chamber 80 *b* in a manner and for a purpose to be explained hereinafter.

It is important to note that the tubes 90 perform the function of heat exchanger tubes. These operate to greatly improve the efficiency of the gas turbine portion of the engine since the pressurized air flow from the compressor 26 has been preheated before its entry into the compression chamber 47. The sequence of events is that relatively cold air is compressed in compressor 26, heated due to the heat exchanger action, passed into the compression chamber 47, and then firing occurs.

The remainder of the engine is substantially as shown and described in connection with FIGS. 1–4 except that the compressor drive mechanism 30 and its parts are used only to rotate the shaft 20 and thus drive the compressor 26 fixed thereto. A further difference in the combined engine of FIGS. 5 and 6 is that the rings 44*a* and 44*b* of the cylinder 44 are of differing lengths in an approximate ratio of one to two for a reason which will be explained in connection with FIGS. 8–10 hereinafter. Also a plurality of valve flappers 100 are arranged in a spaced manner circumferentially about the periphery of an outer chamber 45*a* formed about the right side of the piston 45. Each of the flappers 100 is biased closed by an associated spring 102. The closed position of the flappers 100 is shown in a solid line designation and the open position in a dash line designation. When a sufficient pressure differential exists between the pressurized air passing from the compressor 26 through the inlet 29 and the air in the chamber 80*a*, the flappers 100 will open to provide a pressurized air flow through the chamber. An auxilliary starter motor 104 may be included at the right-hand end of the engine to provide an initial rotative drive through the drive shaft 105, gear 106 and a driven gear 108 fixed to the right end of the shaft 20.

Figure 7:
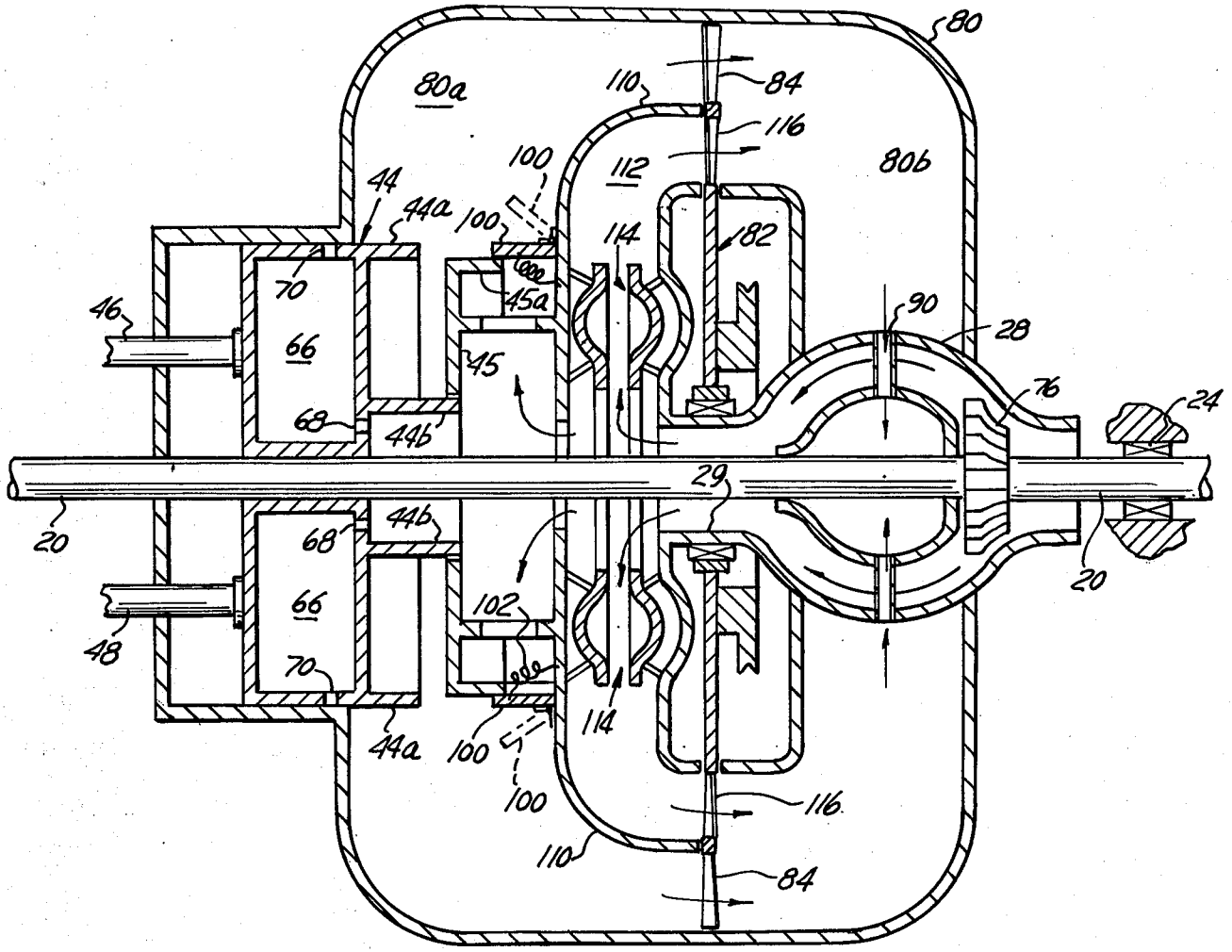
FIG. 7 is a cross-sectional view with parts broken away showing a combined internal combustion and gas turbine engine and further incorporating a standard gas turbine assist stage.

FIG. 7 shows a still further embodiment of my combined engine in which an additional modification has been made in the construction of the housing 80 and to the turbine wheel 82. A separate partition 110 is included rightwardly of the flappers 100 and their associated parts. Thus, a separate channel 112 is formed inside the left-hand chamber 80*a*. A standard turbine stage 114 is mounted in the channel 112 as shown. The turbine wheel 82 includes a second inner ring of turbine blades 116 mounted in the outlet of the channel 112 as shown. The blades 116 have a like alignment to blades 84 with respect to the turbine wheel 82. The pressurized air flow as shown by arrow impinges continuously against the blades 116 to smooth the power take-off and the overall operation of the engine.

Figure 10:
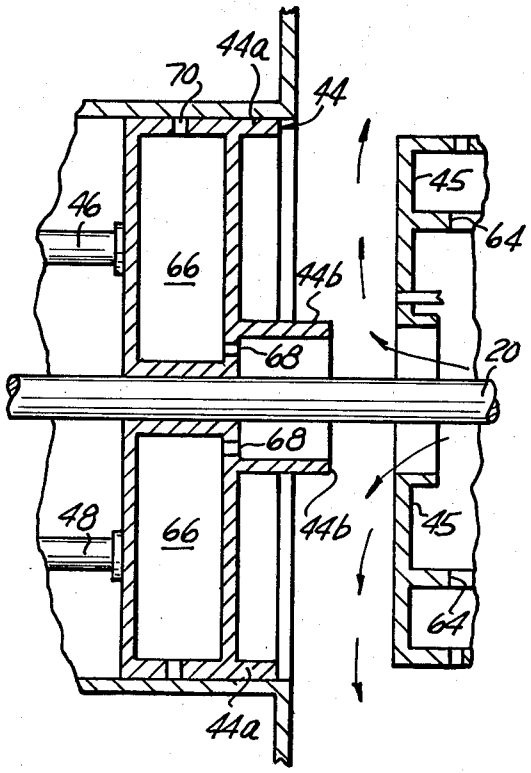
FIG. 10 is a view substantially similar to FIGS. 8 and 9 but showing the cylinder in its extreme left-hand moved position and in a scavenging condition.
Figure 9:
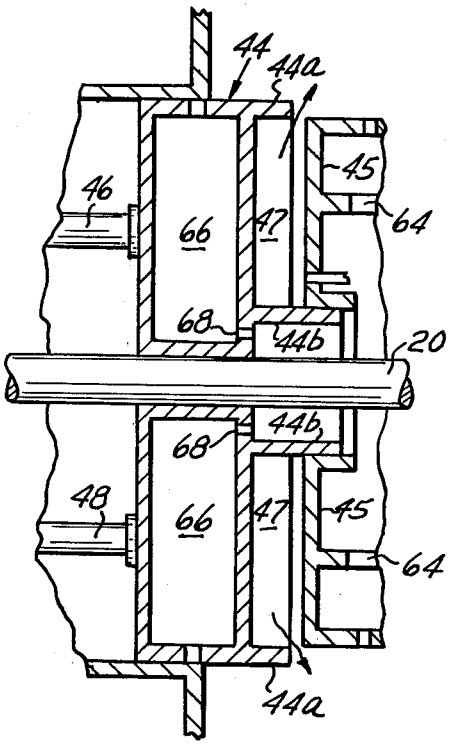
FIG. 9 is a view substantially similar to FIG. 8 but showing the cylinder in its exhaust position and power stage.
Figure 8:
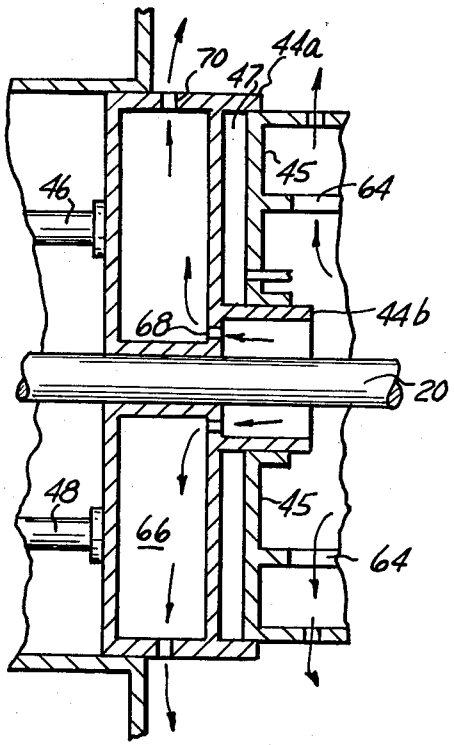
FIG. 8 is a partial sectional view showing the first of the three stages of operation of the combined internal combustion and that gas turbine engine of FIG. 7 and, more particularly, showing the cylinder in its compression and combustion position.

FIGS. 8–10 respectively show the three successive stages of:

(1) Compression and combustion position;
(2) Exhaust and power position;
(3) Scavenging position;

These three operative positions or states are characteristic of the embodiments of my combined internal combustion and gas turbine engine as previously shown and described in connection with FIGS. 5 and 7. The importance of the three different cylinder positions shown and the operation of the combined engine in those positions will be explained in the next following section directed to the operation of the several embodiments of my invention.

Figure 11:
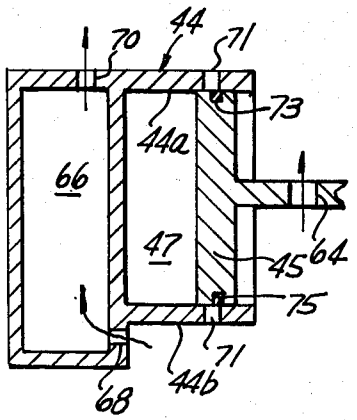
FIGS. 11 and 12 are fragmentary views of an alternate form of my invention.
Figure 12:
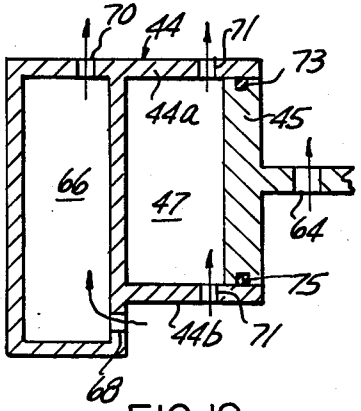

FIGS. 11 and 12 show a modification of the internal combustion engine of FIGS. 1–4. The cylinder 44 and its left-hand chamber 66 are the same as previously described. An additional plurality of ports 71 are formed in the rings 44*a*, 44*b* as shown. The piston 45 is formed with a circumferential groove 73 which retains a sealing ring 75 in place. The improved seal makes possible high compression ratios.

FIG. 11 illustrates the compression stage in which the ports 71 remain closed as firing occurs. As soon as the leftward movement of the cylinder 44 has begun, the ports 71 are opened to allow a cooling inrush of pressurized air from the compressor 26. This further promotes a complete purging of the compression chamber 47 even before the chamber 47 has been completely opened. The piston 45 is also cooled at both sides by pressurized air flow paths as shown by arrow.

DESCRIPTION OF OPERATION

The novel internal combustion engine according to my invention is shown in FIGS. 1–4. The compression position is best shown in FIGS. 1 and 3 wherein the cylinder 44 is in its right-hand position relative to the piston 45. The combustion chamber 47 thus formed receives a fuel charge through the inlet 56. The fuel is ignited by the timed operation of an igniting means such as a spark plug 58. At this time, there are two cooling air flow paths provided by the operation of the compressor 26. One path is through the ports 68 and 70 of the chamber 66 associated with the cylinder 44. The second path is through the port 64 at the right side of the piston 45.

Responsive to the firing of the fuel in the chamber 47, a leftward movement of the cylinder 44 and its associated parts is initiated. When the left-hand extreme position of the cylinder 44 is reached, the compression chamber 47 is fully opened as best shown in FIG. 4. The upper and lower rings 44*a*, 44*b* are both in a like spaced position relative to the piston 45 and a large clearance is provided therebetween to provide the purging air flow path as shown. At the same time, the port 70 is closed by an enclosing sleeve 71 so that the scavenging flow is promoted and all the products of incomplete combustion and pollutants are removed from the combustion chamber 47. A cooling air flow path is continued through the ports 64 to avoid excessive heating, the formation of hot spots, and the generation of additional pollutants such as the oxides of nitrogen, sulphur and the like.

The internal combustion engine embodiment of my invention will thus be seen to provide a greatly simplified and improved two-cycle engine. My engine provides a pollution free operation not possible with prior art engines. The engine is super-charged and air cooled in a novel and controlled fashion to provide an increase in operating efficiency not heretofore possible. The engine is further operable either in a time ignition mode or in a diesel engine mode with minor redesigns to its structure.

Description will now be made with respect to the operation of my combined internal combustion and gas turbine engine as shown in the embodiment of FIG. 5 or in the alternate embodiment of FIG. 7. It will again be understood that the internal combustion portion of the combined engine may be operated either in a timed ignition mode or in a diesel engine mode. Reference is now made to the FIG. 5 drawing. In the combined engine, the mechanism 30 is used to convert the longitudinal reciprocating movement of the cylinder 44 into a rotative drive which in turn is used to rotate the shaft 20 and drive the compressor stage 26. Drive take-off is taken from the hub or pulley 86 of the turbine wheel 82 as shown. A continuous pressurized flow assist may be added by the incorporation of a standard gas turbine stage 114 as was shown in the embodiment of FIG. 7.

FIGS. 8–10 illustrate the sequential mode of operation of my combined engine. FIG. 8 shows the cylinder 44 in its right-hand position to provide both compression and combustion of the fuel previously injected into the chamber 47. During this part of the cycle, two separate cooling air path flows are provided as shown in FIG. 8, to the left of the cylinder 44 through the chamber 66 and to the right of the stationary piston 45 through the ports 64.

After ignition occurs, the exhaust and power stage is begun. This stage is illustrated in FIG. 9. Because the outer ring 44*a* is shorter than the inner ring 44*b* of the cylinder 44, a rapid outward exiting flow of combusted gases first occurs about the outer periphery of the engine. This provides a powerful air flow surge through the chamber 80*a* as shown in FIGS. 5 and 7 and outwardly through the chamber 80*b* to provide a rotative torque to the blades 84 of the turbine wheel 82 and finally out to ambient through the ports 90.

The final and scavenging portion of the operation of the engine is shown in FIG. 10. The purging flow path from the compressor 26 is passed through the now completely opened compression chamber 47. The path through the chamber 66 is closed off through the closure of the port 70. The explosive flow of combusted fuel is thus cooled by the incoming air flow and passed to the blades 84 to provide a powerful force of torque to the turbine wheel 82. In the case of the FIG. 7 embodiment, a further smoothing action and power assist is provided to the engine through the turbine stage 114 mounted in the separate channel 112.

Reference is now made to the FIG. 7 showing of my invention. It will be seen that while the compression chamber 47 is still opening, the firing can continue until the chamber has reached near bottom dead center or slightly beyond dead center. This gives additional hot gases to provide rotative force to the turbine wheel 82.

When the cylinder 44 is approaching the piston 45, the firing is terminated and clean air flow from the compressor 26 is used to purge the space between the cylinder 44 and the piston 45. When the firing stops, the pressure in the chamber 80*a* in advance of the turbine wheel 82 drops sharply and the plurality of value flappers 100 are opened and admit a cooling air flow to the chamber 80*a* and about the piston 45.

In accordance with the teachings of my invention, the turbine wheel can be subjected to higher than average temperatures of gases from the combustion chamber. This is because the initial hot gas outflow from the compression chamber 47 is each time followed by lower combustion temperature gases, then by relatively cool air from the compressor 26. The blades 84 thus are subjected to the average value of the above several different temperature gases.

It will thus be seen that by my invention I have provided a relatively pollution free engine of greatly improved efficiency and performance with a construction not known to the prior engine art.

I claim:

1. An air-cooled, super charged internal combustion engine comprising:

a stationary piston having an end face portion;

a cylinder movable longitudinally relative to said piston face portion from a first abutting position to a second spaced position; a compression chamber formed therebetween in said first position;

means for providing a pressurized air flow stream;

a plurality of ports in said cylinder for passing said stream therethrough;

a further port associated with said piston for passing said stream in cooling proximity to the back surface of said piston face portion;

means for admitting a fuel to said chamber;

means for igniting said fuel and providing such longitudinal movement of said cylinder from said first to said second position;

means enabling the cylinder to disengage contact with the piston in the second position;

means for passing said stream through said cylinder responsive to its movement to said second position; and means for returning said cylinder to said first position.

2. The combination as set forth in claim 1 wherein said means for providing said air flow stream comprises a compressor stage positioned proximate said cylinder and said piston.

3. The combination as set forth in claim 2 wherein said compressor stage is positioned substantially coaxial with said piston and cylinder.

4. The combination as set forth in claim 3 wherein said cylinder is of annular configuration.

5. The combination as set forth in claim 4 wherein said compressor stage is rotatively mounted on a driven shaft, said shaft being concentric with said cylinder and said piston.

6. The combination as set forth in claim 1 wherein a further means is operably connected to said cylinder for converting its said longitudinal movement to a rotary movement.

7. The combination as set forth in claim 6 wherein said further means comprises a crankshaft operatively coupled to said cylinder.

8. An internal combustion engine comprising:

a stationary hollow piston having a cooling channel rearwardly located relative to its face;

a cylinder movable longitudinally relative to said piston between a first and a second position;

said cylinder in its first position operable to form a combustion chamber intermediate it and said piston;

means for supplying a fuel to said chamber;

means for igniting said fuel to move said cylinder from its first to its second position in a first cycle of operation responsive to combustion of said fuel;

means for limiting the movement of said cylinder in its second position and allowing a disengagement of contact between said cylinder and piston;

means for supplying a pressurized flow of air through said channel in said first position and into said combustion chamber in the second position of said cylinder;

and means for returning said cylinder from its second to its first position preparatory to the next cycle of operation.

9. The combination as set forth in claim 8 wherein said means for supplying a pressurized flow of air comprises an axial compressor stage.

10. The combination as set forth in claim 9 wherein said cylinder further has a plurality of ports formed therein for allowing air flow therethrough in its first position.

11. The combination as set forth in claim 8 wherein one surface of said piston is in communication with said air flow.

12. The combination as set forth in claim 8 wherein a crankshaft is operably connected though a push rod to said cylinder for providing a rotary power take-off responsive to the longitudinal movement of said cylinder.

13. An air-cooled, super charged internal combustion engine comprising:

a fixed piston;

a cylinder movable in a reciprocal manner relative to said piston between a first and a second position;

a combustion chamber formed between abutting opposed parts of said piston and cylinder in the first position of said cylinder;

means for supplying and igniting a fuel in said chamber to provide combustion means to initiate the movement of said cylinder towards its second position such that a disengagement of contact is provided between opposed surfaces of said cylinder and piston;

means for providing a pressurized stream of air through the space between the disengaged cylinder and piston; and means for returning said cylinder to its first position preparatory to another cycle of operation.

14. The combination as set forth in claim 13 wherein said means for providing a pressurized stream of air further has its output in communication with one outer surface of said cylinder in its first position.

15. The combination as set forth in claim 13 wherein said means for providing a pressurized stream of air is further in communication with one outer surface of said piston in the first position of said cylinder.

16. The combination as set forth in claim 13 wherein said cylinder and said piston are of annular configuration, both having a common driven shaft extending centrally therethrough and wherein said means for providing a pressurized stream of air comprises an axial compressor mounted on said shaft.

17. The combination as set forth in claim 16 wherein a power take-off means is operably connected to said cylinder for converting its reciprocal movement to a rotary power take-off movement.

18. The combination as set forth in claim 17 wherein said power take-off means comprises a crankshaft coupled to said cylinder through a push rod.

19. The combination as set forth in claim 18 wherein said crankshaft is further coupled to said shaft by a reduction gear train.

20. An internal combustion diesel engine comprising a stationary annular piston;

an annular cylinder movable longitudinally relative to said piston between a first and a second position and having a pair of flanges extending about the periphery of said piston and forming a compression chamber therebetween in its first position;

means for admitting a fuel to the said chamber prior to the movement to the first position of said cylinder to fire the fuel and initiate its movement towards the second position in a power stroke;

means for providing a pressurzed air flow through an open space left between said flanges and said pistons during movement of the cylinder to its second position to purge the products of combustion from said chamber, said cylinder and piston disengaged from contact in said second position; and means for returning said cylinder to its first position in a compression stroke preparatory to a second cycle of operation.

21. A internal combustion engine of the diesel type comprising:

a piston of the stationary type;

a cylinder movable in a reciprocal manner relative to said piston between a first and a second position;

a combustion chamber formed between adjacent ends of said piston and cylinder in the first position of said cylinder;

means for supplying fuel to said chamber to provide combustion under compression in said first position and thus initiate the movement of said cylinder to its second position, means enabling the cylinder to disengage contact between the adjacent ends of said cylinder and piston in said second position; and means for providing a pressurized stream of purging and cooling air through said space.

22. The combination as set forth in claim 21 wherein said means for providing a pressurized stream of air is further in communication with one outer surface of said cylinder in its aforesaid first position.

23. The combination as set forth in claim 21 wherein said means for providing the pressurized stream of air is further in communication with at least one outer surface of said piston in the first position of said cylinder.

* * * * *